US010760787B2

(12) United States Patent
Brennwald et al.

(10) Patent No.: US 10,760,787 B2
(45) Date of Patent: Sep. 1, 2020

(54) GRATE BLOCK FOR A COMBUSTION GRATE

(71) Applicant: HITACHI ZOSEN INOVA AG, Zurich (CH)

(72) Inventors: Werner Brennwald, Neftenbach (CH); Helen Gablinger, Zurich (CH)

(73) Assignee: HITACHI ZOSEN INOVA AG, Zurich (CH)

( * ) Notice: Subject to any disclaimer, the term of this patent is extended or adjusted under 35 U.S.C. 154(b) by 36 days.

(21) Appl. No.: 15/735,910

(22) PCT Filed: Jun. 12, 2015

(86) PCT No.: PCT/EP2015/063146
§ 371 (c)(1),
(2) Date: Dec. 12, 2017

(87) PCT Pub. No.: WO2016/198119
PCT Pub. Date: Dec. 15, 2016

(65) Prior Publication Data

US 2018/0347811 A1 Dec. 6, 2018

(51) Int. Cl.
*F23H 3/04* (2006.01)
*F23H 7/08* (2006.01)
*F23H 17/12* (2006.01)

(52) U.S. Cl.
CPC ..... *F23H 3/04* (2013.01); *F23H 7/08* (2013.01); *F23H 17/12* (2013.01); *F23H 2700/009* (2013.01)

(58) Field of Classification Search
CPC ..... F23H 3/04; F23H 7/08
See application file for complete search history.

(56) References Cited

U.S. PATENT DOCUMENTS 1,346,464 A * 7/1920 Roach ..... F23K 3/10 110/283
2,431,799 A * 12/1947 Gaffney ..... F27D 15/0213 110/268

(Continued)

FOREIGN PATENT DOCUMENTS

DE 19613507 C1 8/1997
DE 102004040048 A1 2/2006

(Continued)

OTHER PUBLICATIONS

Mar. 5, 2019 Office Action issued in Japanese Patent Application No. 2017-563922.

(Continued)

*Primary Examiner* — Nathaniel Herzfeld
(74) *Attorney, Agent, or Firm* — Oliff PLC

(57) ABSTRACT

A grate block for a combustion grate, wherein consecutive grate blocks are arranged in a staircase and are designed to rearrange and convey the combustible material during combustion through pushing motions. The grate block includes a block body, an upper wall forming a supporting surface, and an extension parallel to a longitudinal axis L of the body. The supporting surface drops into a pushing surface formed by a front wall, which has at least one air supply opening for supplying air to the combustion grate, which extends at a right angle or slant to the pushing surface. In the lowest region of the front wall, formed as a foot, which lays on the supporting surface of a grate block, is adjacent in the pushing direction. The front resting edge of the pushing surface is arranged in a plane E extending at a right angle to the longitudinal axis L.

13 Claims, 8 Drawing Sheets

(56) References Cited

U.S. PATENT DOCUMENTS

| | | | | | |
|---|---|---|---|---|---|
| 3,014,439 | A * | 12/1961 | Mitchell | F23H 3/02 | 110/268 |
| 3,753,299 | A * | 8/1973 | Schreiner | C02F 1/10 | 34/237 |
| 3,985,084 | A * | 10/1976 | Delaplace | F23H 7/08 | 110/281 |
| 4,078,883 | A * | 3/1978 | Arnold | F23H 17/00 | 432/239 |
| 4,275,706 | A * | 6/1981 | Pauli | F23H 1/02 | 110/268 |
| 4,463,688 | A * | 8/1984 | Andreoli | F23L 1/02 | 110/278 |
| 4,719,900 | A * | 1/1988 | Martin | F23H 17/12 | 110/281 |
| 5,197,397 | A * | 3/1993 | Yamagishi | F23H 3/02 | 110/281 |
| 5,245,983 | A * | 9/1993 | Krieger | F23H 3/02 | 110/281 |
| 5,299,555 | A * | 4/1994 | Claes | F27D 15/022 | 126/152 B |
| 2004/0261674 | A1* | 12/2004 | Hepp | F23G 5/002 | 110/346 |
| 2010/0122643 | A1* | 5/2010 | Cole | F23G 5/444 | 110/298 |
| 2012/0012037 | A1* | 1/2012 | Spliethoff | F23H 7/08 | 110/267 |
| 2013/0167762 | A1* | 7/2013 | Schmid | F23H 7/08 | 110/348 |
| 2017/0276348 | A1* | 9/2017 | Hammerich | F23H 7/08 | |

FOREIGN PATENT DOCUMENTS

| | | | |
|---|---|---|---|
| EP | 0919771 | A2 | 6/1999 |
| EP | 0921354 | A1 | 6/1999 |
| EP | 1191282 | A1 | 3/2002 |
| GB | 2483479 | A | 3/2012 |
| JP | S54-18076 | U | 2/1979 |
| JP | H10-267250 | A | 10/1998 |
| JP | 2012-507688 | A | 3/2012 |
| WO | 2010/051953 | A1 | 5/2010 |

OTHER PUBLICATIONS

Mar. 23, 2016 Search Report issued in International Patent Application No. PCT/EP2015/063146.

Dec. 12, 2017 International Preliminary Report on Patentability issued in International Patent Application No. PCT/EP2015/063146.

* cited by examiner

GRATE BLOCK FOR A COMBUSTION GRATE

The invention relates to a grate block for a combustion grate according to the preamble of claim 1. The invention further relates to a combustion grate comprising at least one such grate block. The invention further relates to the use of the said combustion grate for the combustion of waste and a waste combustion installation comprising such a combustion grate.

Combustion grates for the industrial combustion of waste have been known to the person skilled in the art for some time. Such combustion grates may, for example, be in the form of pushing combustion grates which include movable components which are suitable for carrying out stoking travel operations. In this instance, the combustion material is conveyed from an inlet-side end of the combustion grate toward the outlet-side end thereof and burnt during this time. In order to supply the combustion grate with the oxygen required for the combustion, there are provided corresponding air supplies which can be directed through the combustion grate and via which the so-called primary air is introduced.

A frequently used combustion grate is the so-called step grate. This comprises grate blocks which are arranged beside each other and which in each case form a grate block row. The grate block rows are in this instance arranged one above the other in the manner of steps, wherein, with so-called feed grates, the front end of a grate block when viewed in the pushing direction is positioned on a support face of the adjacent grate block in the transport direction and is moved on this support face with a corresponding pushing movement. With so-called reciprocating grates, the grate blocks are arranged in a state rotated through 180° with respect to feed grates when viewed in the transport direction of the combustion material.

Therefore, with reciprocating grates, the front end of the grate block when viewed in the pushing direction is positioned on a support face of the previous grate block in each case. In contrast to feed grates, with reciprocating grates the pushing direction is consequently counter to the transport direction produced by the inclination of the reciprocating grate.

A combustion grate which is constructed as a feed grate and a grate block for such a combustion grate is described, for example, in EP 1 191 282 which relates to a water-cooled grate block. Another combustion grate of the described type is further described, for example, in EP 2 184 540 which relates to an air-cooled grate block.

In specific terms, the grate block described in EP 1 191 282 comprises a block member which is constructed as a cast component and which has an upper wall which forms a support face for the waste which is intended to be handled and a front wall. In the lower region of the front wall, there is formed a base which is intended to be positioned in a displaceable manner on the support face of a grate block which is adjacent in the pushing direction, whilst openings for introducing the primary air are arranged in the upper region of the front wall.

As a result of the combustion material which is conveyed via the grate blocks, they are generally subjected to a relatively high level of wear. In this case, the abrasion is particularly high precisely in the region of the foremost end of the support face, where the combustion material is thrown from the support face of the grate block via a corresponding discharge edge onto the support face of the subsequent grate block. This may in particular also lead to an erosion of the air outlet openings which are arranged below the edge which may have a negative influence on the controlled air supply to the combustion bed which is located on the combustion grate.

Furthermore, for an operator of a combustion installation it often cannot readily be seen with the naked eye when the grate block has exceeded its service-life or how far the abrasion has already progressed. In order to ensure reliable operation of the installation, but nonetheless to prevent unnecessary replacement of still operational grate blocks, a simple examination of the degree of abrasion with the naked eye is therefore desirable.

According to a first aspect, consequently, the object to be achieved according to the invention is to provide a grate block which is mentioned in the introduction and which has a long service-life and in which in particular the erosion of the wall portion which contains the air supply openings is minimized.

According to a second aspect, the object to be achieved according to the invention is to provide a grate block which is mentioned in the introduction and which enables a simple examination of the degree of abrasion.

The object according to the above-described first aspect is achieved with the grate block defined in the independent claim 1, whilst the object according to the above-described second aspect is achieved by the grate block defined in the independent claim 12. Preferred embodiments of the grate block according to the invention are set out in the claims which are dependent on the independent claims in each case.

According to claim 1, the present invention consequently relates to a grate block for a combustion grate in which sequential grate blocks are arranged one above the other in a step-like manner and are configured so as to rearrange and convey the combustion material during combustion by means of pushing movements which are carried out relative to each other. Such combustion grates are as mentioned in the introduction also referred to as step grates.

The grate block according to the invention comprises a block member which is constructed as a cast component. Generally, the block member is constructed substantially in the form of an elongate parallelepiped with a longitudinal axis L.

The block member comprises an upper wall which forms a support face which extends at least partially parallel with the longitudinal axis L of the block member and along which the combustion material is intended to be conveyed and whose foremost end when viewed in the pushing direction S forms an edge via which the support face descends into a pushing face which is formed by a front wall.

The front wall has at least one air supply opening which when viewed as a longitudinal section extends perpendicularly or obliquely with respect to the pushing face in order to supply air to the combustion grate and is constructed in the lowest region thereof in the form of a base which is intended to be positioned on the support face of a grate block which is adjacent in the pushing direction.

In the preferred embodiment in which the grate block according to the invention is intended for a feed grate, the base is consequently positioned on the subsequent grate block in the transport direction of the combustion material or the support face thereof. However, it is also conceivable for the grate block according to the invention to be intended for a reciprocal grate; in this instance, the base is positioned on the previous grate block in the transport direction of the combustion material or the support face thereof.

At least the front support edge of the pushing face is arranged in a plane E which extends substantially perpendicularly to the longitudinal axis L. It is conceivable in this regard for a plane which is arranged in the lowest region of the front wall and whose lower end is formed by means of the front support edge to be arranged in the plane E, whereas it is also conceivable for only the line described by the front support edge to be arranged in the plane E.

According to the invention, the edge is offset forward with respect to the plane E when viewed along the longitudinal axis L and in the pushing direction S. It can thereby be ensured that at least a portion of the pushing face is subjected to reduced erosion by means of the combustion material and that in particular the air can be more easily discharged through the air supply opening(s). In comparison with previously known grate blocks, it is consequently ultimately possible according to the invention to obtain a minimization of the abrasive forces acting on the pushing face and consequently the abrasion-related wear of the grate block.

As in the grate blocks according to EP 1 191 282, in the grate block according to the present invention, the at least one air supply opening is also arranged below the edge via which the support face descends into the pushing face.

According to a particularly preferred embodiment of the invention, however, it is offset backward with respect to the edge when viewed along the longitudinal axis L and in the pushing direction S. In other words, the region of the pushing face, in which the at least one air supply opening is arranged, is arranged in a plane which when viewed along the longitudinal axis L and in the pushing direction S is offset backward with respect to the edge. This represents a clear difference with respect to the grate blocks according to EP 1 191 282 in which the edge is in the same plane as the pushing face.

According to another preferred embodiment, the upper wall and the front wall are constructed in a thickened manner in the region in which they meet each other, wherein the wall thickening is constructed in a curved manner when viewed as a longitudinal section, that is to say, is in the form of a bead. As a result of the wall thickening in the region of the grate block which is subjected to a particularly heavy wear, an increase of the service-life of the grate block can be achieved since a significantly greater abrasion can be tolerated.

In specific terms, the edge when viewed along the longitudinal axis L and in the pushing direction S is offset forward with respect to the plane E by at least 3 mm, preferably by at least 5 mm, and most preferably by at least 10 mm.

It is further preferable for the edge when viewed along the longitudinal axis L and in the pushing direction S to be offset forward with respect to the plane E by a maximum of 100 mm, preferably by a maximum of 50 mm and most preferably by a maximum of 30 mm.

Consequently, the spacing with which the edge is offset forward with respect to the plane E is preferably in the range from 3 mm to 100 mm, particularly preferably in the range from 5 mm to 50 mm and most preferably in the range from 10 mm to 30 mm. Consequently, a long service-life and in particular a reduction of the erosion of the wall portion which contains the air supply openings can be ensured without having to deviate significantly from the basic shape of established grate blocks such as the one according to EP 1 191 282.

According to another preferred embodiment, the at least one air supply opening when viewed as a longitudinal section extends at an angle $\alpha$ with respect to the region of the pushing face directly adjacent to the respective air supply opening, wherein $\alpha$ is in a range from 90° to 135°, preferably from 95° to 125°, in a particularly preferred manner from 100° to 120° and most preferably from 105° to 115°. An optimal primary air supply to the combustion grate or the combustion bed is thereby obtained on the combustion grate, which contributes to a very high burnout of the combustion material. The region of the air supply opening which is relevant for the determination of the angle $\alpha$ is in this instance the region directly in front of the outlet of the respective air supply opening from the front wall. If the region of the pushing face directly adjacent to the respective air supply opening is constructed in a curved manner, the tangent which is produced in this region is relevant for the determination of the angle $\alpha$.

Generally, the grate block is closed laterally by a side wall which extends in the longitudinal direction. In this instance, according to a particularly preferred embodiment, at least one side wall has a wear marking which describes a contour which is spaced apart from the plane of the support face and/or from the plane of the pushing face.

As described in detail below, the wear marking enables the degree of abrasion to be determined very easily by sight. Consequently, on the one hand, it can be ensured that a worn grate block is identified promptly, which contributes to more reliable operation of the combustion grate. On the other hand, it is made possible for the grate block to be actually used until the end of its service-life; a replacement of a grate block which is still operational per se is consequently prevented.

As a result of the fact that the original spacing between the contour of the wear marking and the outer contour of the grate block is known, it can additionally be predicted in a relatively reliable manner when the grate block will become worn with operation remaining consistent.

Preferably, the contour of the wear marking is spaced apart from the plane of the support face and/or from the plane of the pushing face by from 15 mm to 30 mm, most preferably by from 20 to 25 mm. This spacing corresponds to the maximum permissible abrasion of the grate block up to which it is still fully functional.

It is further preferable for the contour of the wear marking to extend at least partially parallel with the plane of the support face and/or the pushing face. This enables particularly simple examination of the degree of abrasion at the individual locations of the grate block.

In a particularly preferred manner, the contour of the wear marking extends parallel at least with the region of the support face and the pushing face where they meet each other. This is because the grate block is subjected to a particularly high level of wear precisely in that region and an examination of the degree of abrasion is consequently particularly relevant in this region.

It is further preferable for the wear marking to be constructed in the form of a notch or a recess. The notch or the recess may be constructed to be continuous or interrupted in this case. According to this embodiment, the additional material which is required for the preferred wall thickening in the region of the discharge edge can be at least partially compensated for or even over-compensated for by the material saving enabled by the notch or the recess. Since the notch or the recess is formed in the side wall and consequently in a region of the grate block which is subjected to a relatively weak load, this material saving is not at the expense of the stability or the service-life of the grate block.

In addition, it is conceivable on the support face of the grate block to provide a projection or a profiling which acts as an additional wear marking. The abrasion can thus be determined in a very simple manner by means of the erosion of the projection or the profiling. In particular, this additional wear marking can be provided with indications which relate to the grate block and which are intended to be visible at least temporarily. The additional wear marking may thus be provided with, for example, the indication of origin or the "stamp" of the grate block manufacturer.

As mentioned, the present invention, in addition to the grate block described above, further relates to a grate block according to the independent claim 12.

Accordingly, the present invention consequently also relates to a grate block for a combustion grate of the type described above, which comprises a block member which is constructed as a cast component and which comprises an upper wall which forms a support face which extends parallel with a longitudinal axis L of the block member and along which the combustion material is intended to be conveyed and whose foremost end when viewed in the pushing direction S forms an edge for the combustion material, via which the support face descends into a pushing face formed by a front wall.

The grate block is closed at least at one side by means of a side wall which extends in the longitudinal direction. It is characterized according to the invention in that at least one side wall has a wear marking which describes a contour which is spaced apart from the plane of the support face and/or from the plane of the pushing face.

As mentioned, as a result of the presence of the wear marking, the degree of abrasion can be determined very readily by sight. The grate block has thus generally then reached the end of its service-life when the outer contour of the grate block at least partially coincides with the contour of the wear marking or when the contour of the wear marking is no longer visible at all.

The grate block according to claim 12 may additionally in particular have the features of claim 1, that is to say, in particular have an edge which is offset forward with respect to the plane E in the longitudinal axis L and when viewed in the pushing direction S. Furthermore, the preferred features disclosed for the grate block according to claim 1 are also preferred for the grate block according to claim 12.

According to another aspect, the present invention further relates to a combustion grate comprising at least one of the above-described grate blocks.

Furthermore, the present invention relates to the use of a combustion grate described above for burning waste and a waste combustion installation comprising such a combustion grate.

The invention is illustrated with reference to the appended Figures, in which.

Figure 1:
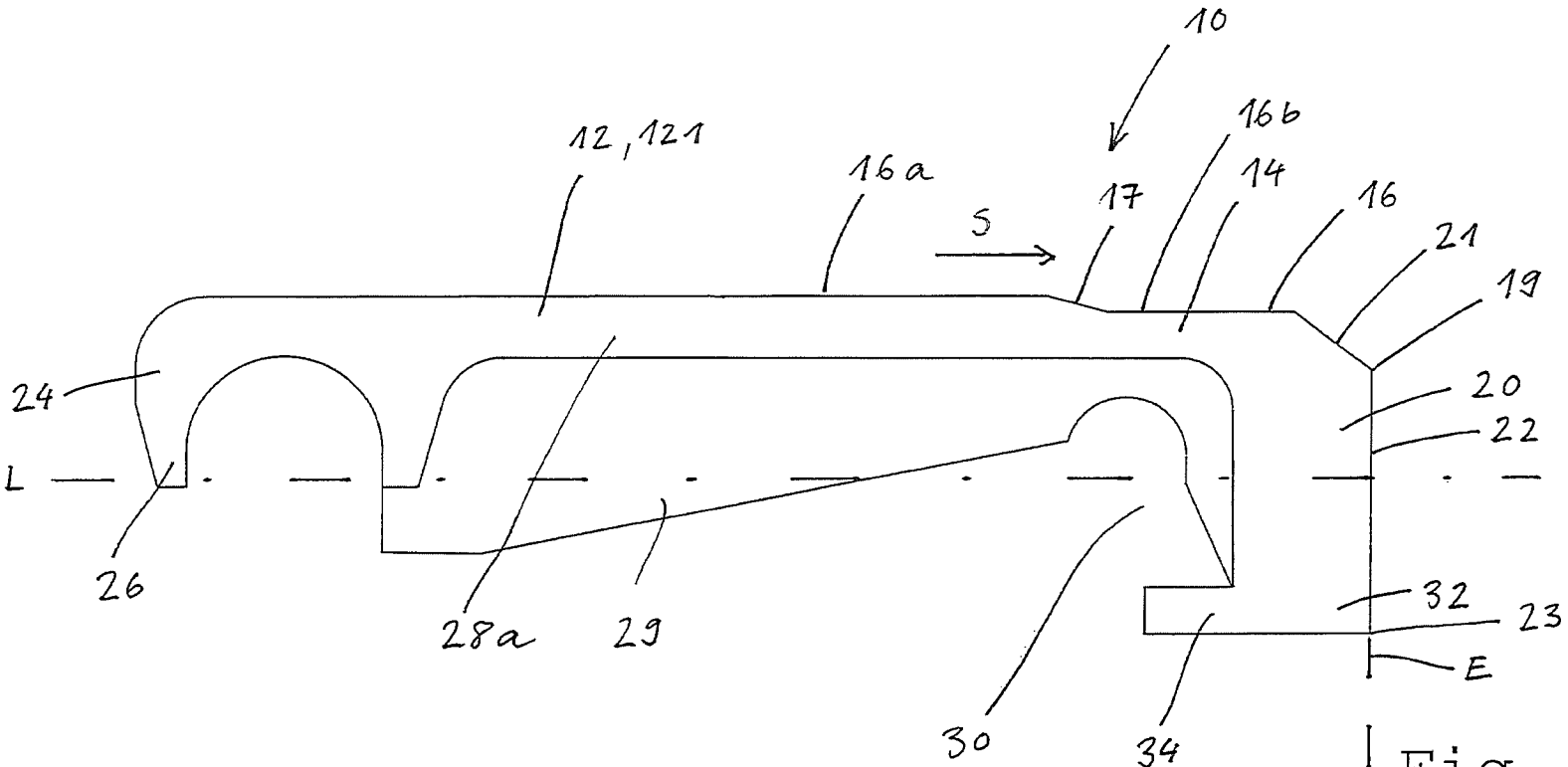
FIG. 1 is a side view of a grate block according to the prior art.
Figure 2:
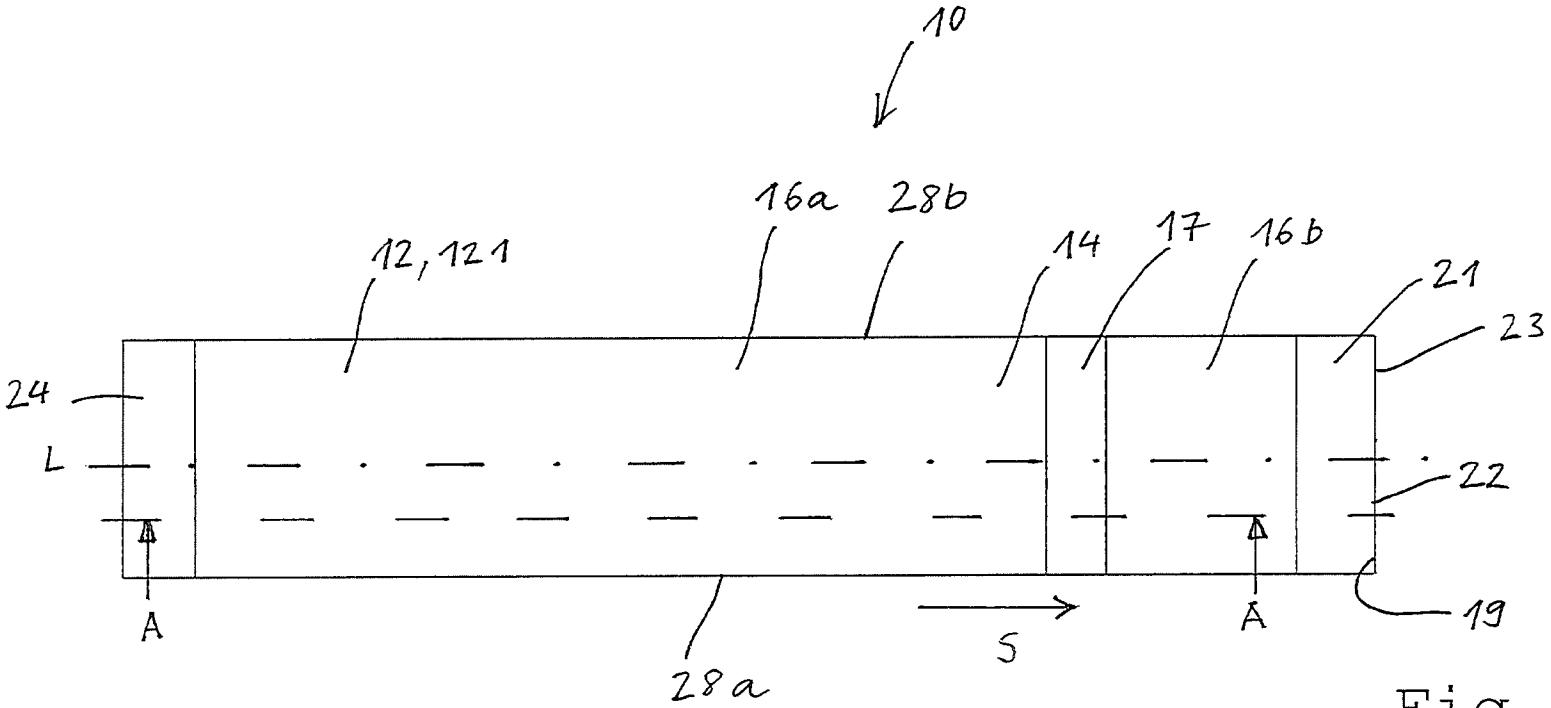
FIG. 2 is a plan view from above of the grate block of the prior art as shown in FIG. 1.
Figure 3:
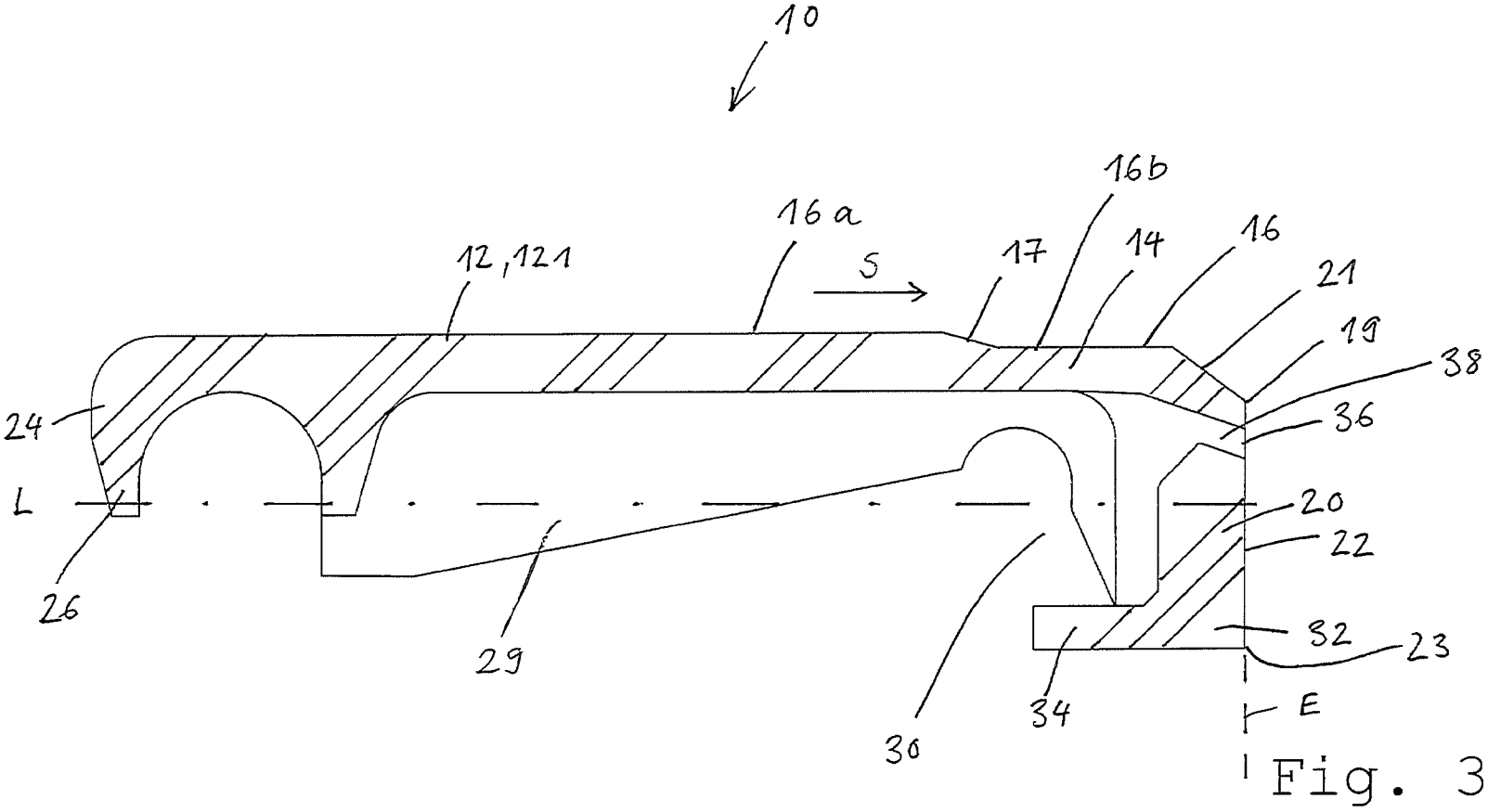
FIG. 3 is a longitudinal section through the plane of section A-A of the grate block of the prior art as shown in FIGS. 1 and 2.
Figure 4:
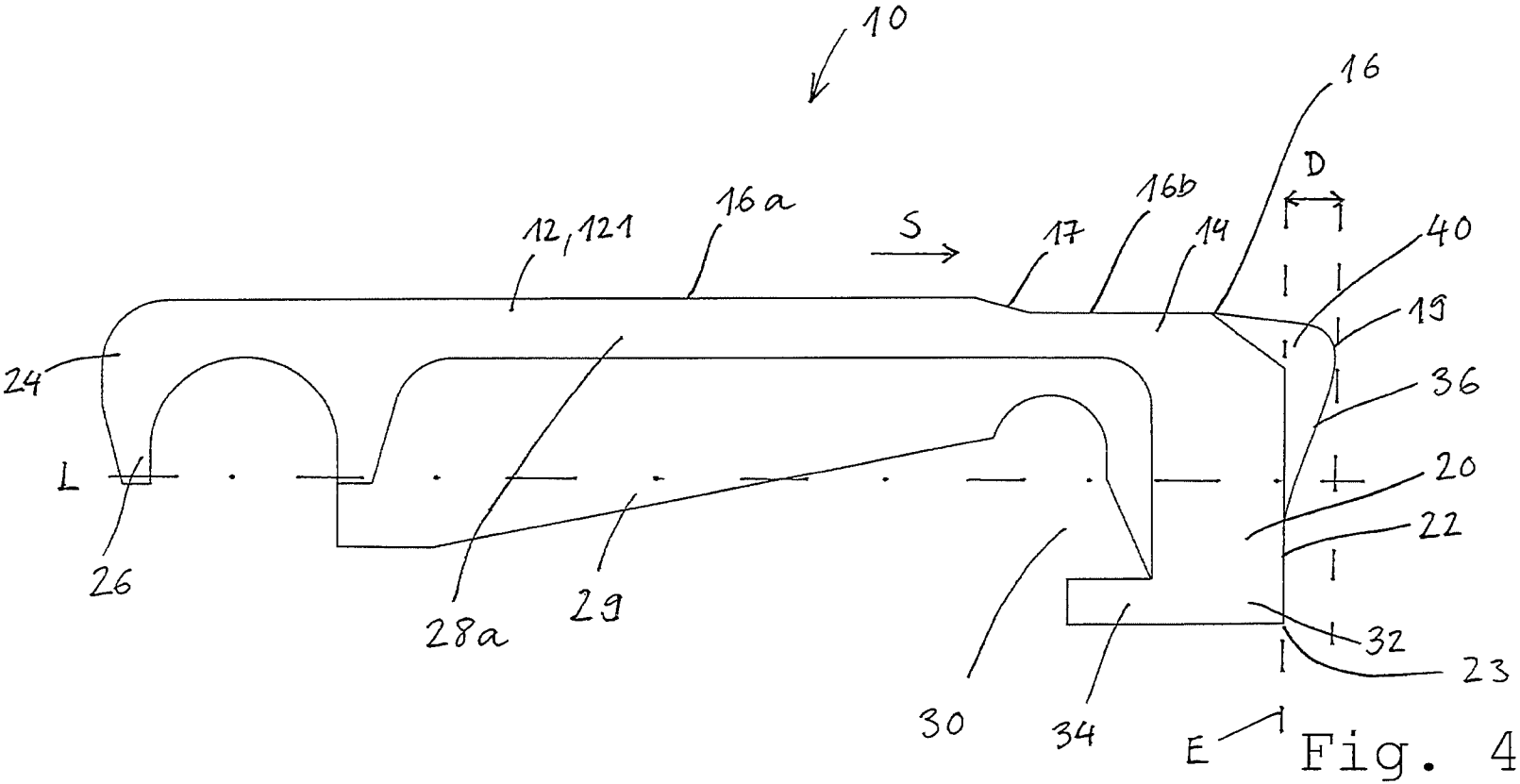
FIG. 4 is a side view of a grate block according to the first aspect of the present invention.
Figure 5:
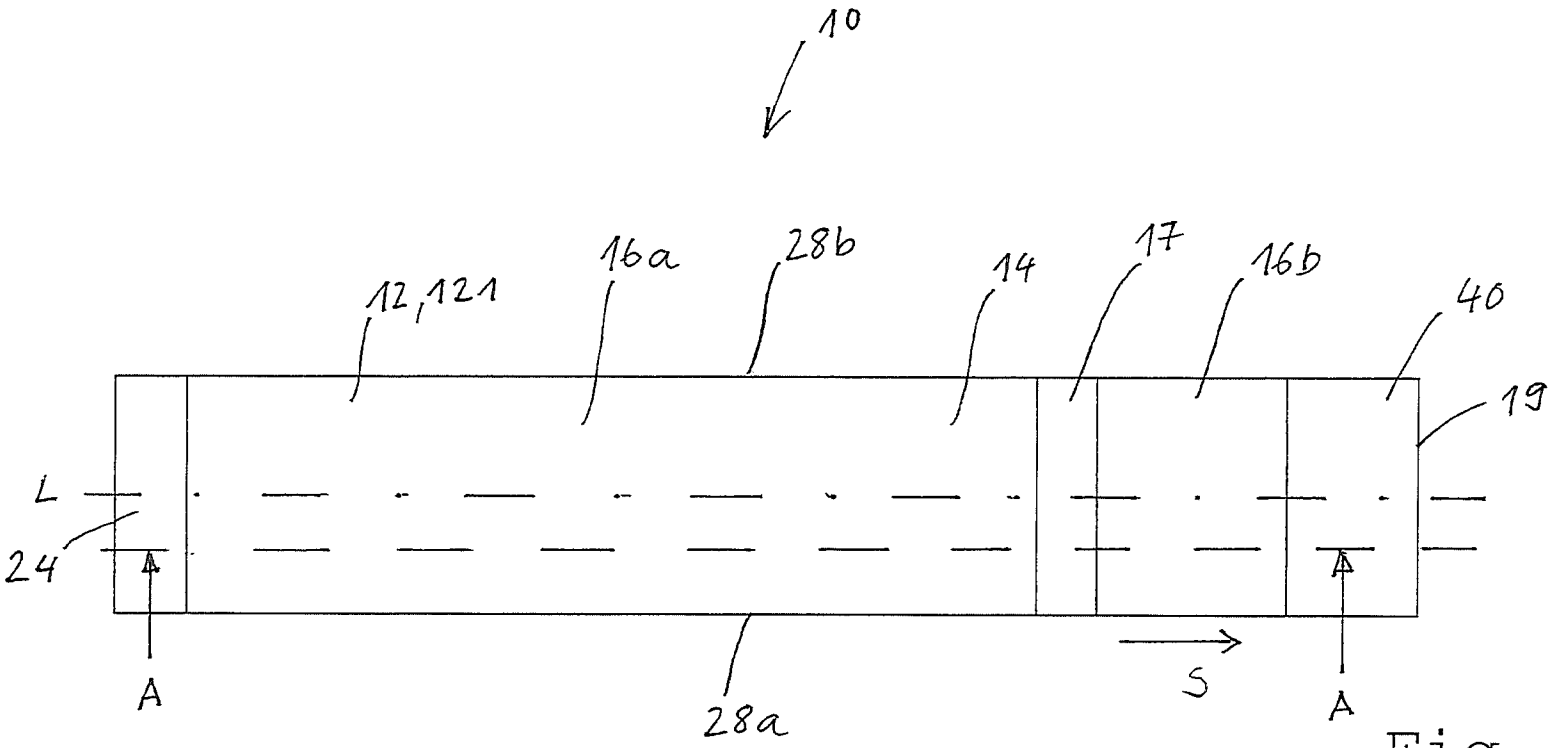
FIG. 5 is a plan view from above of the grate block according to FIG. 4.
Figure 6:
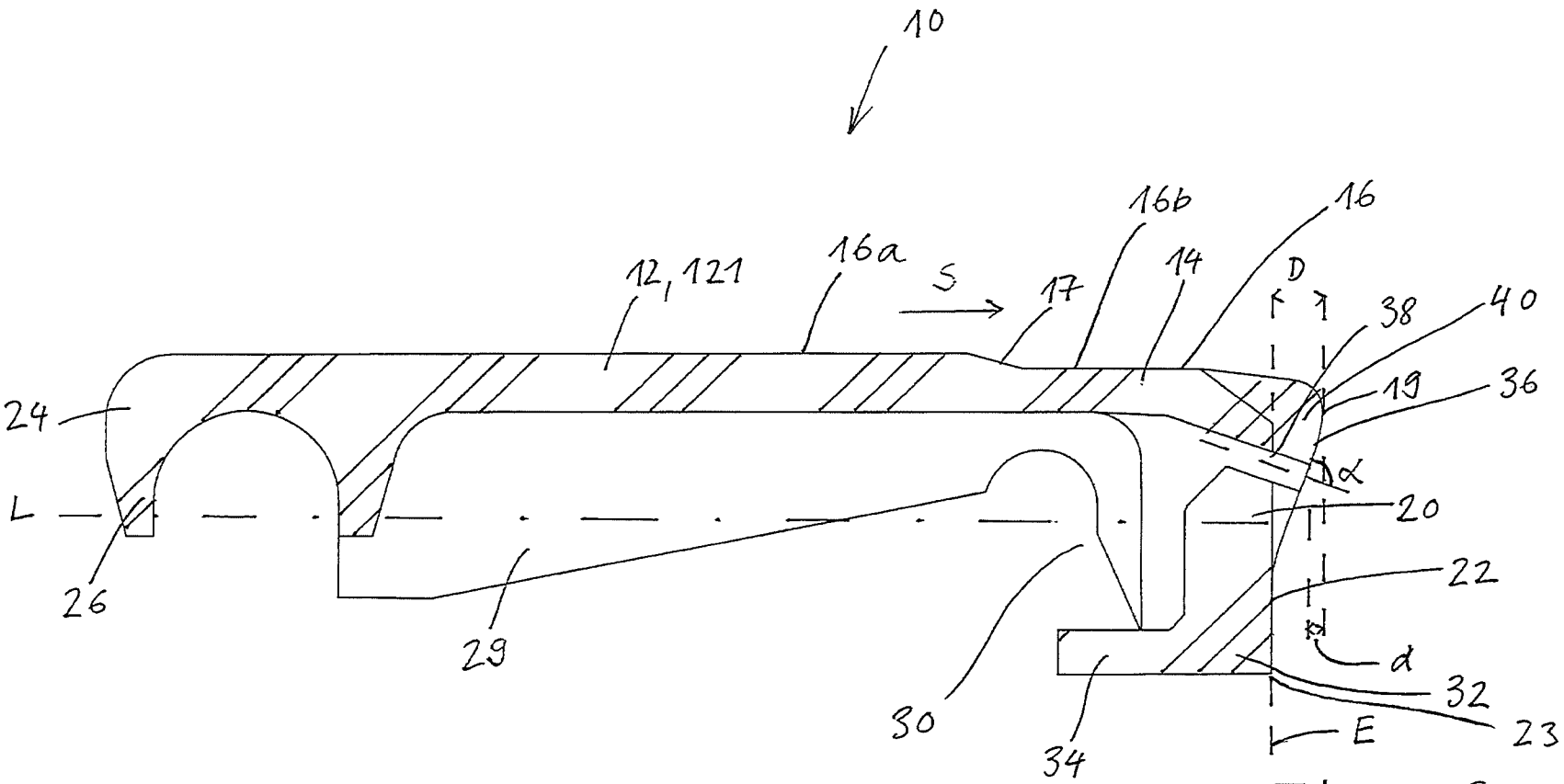
FIG. 6 is a longitudinal section through the plane of section A-A of the grate block according to FIGS. 4 and 5.

As can be seen in FIGS. 4 to 6 in comparison with FIGS. 1 to 3, the grate block 10 according to the invention has in common with previously known grate blocks the fact that it comprises a block member 12 which is constructed as a cast component and which is constructed substantially in the form of an elongate parallelepiped 121 with a longitudinal axis L.

The block member 12 comprises an upper wall 14, which forms a support face 16 which extends parallel with the longitudinal axis L and along which the combustion material is intended to be conveyed and whose foremost end when viewed in the pushing direction S forms an edge 19 via which the support face 16 descends into a pushing face 22 formed by a front wall 20. In the embodiments shown, the support face has a first support face region **16*a* and a second support face region 16*b* which both extend parallel with the longitudinal axis L, but wherein the first support face region 16*a* is arranged so as to be offset in an upward direction with respect to the second support face region 16*b* and is connected thereto by means of a chamfered transition 17**.

Furthermore, in the embodiment of the prior art as shown in FIGS. 1 to 3, the region of the support face located directly in front of the edge is constructed in the form of a chamfer 21.

At the side opposite the front wall 20, the block member 12 has a rear wall 24 which is provided with at least one hook 26 by means of which the grate block 10 can be suspended in a block retention pipe. At the lower side of the grate block 10 facing away from the support face, a central web 29 is additionally arranged.

Laterally, the grate block 10 is closed in each case by means of a side wall **28*a*, 28*b*** which extends in the longitudinal direction.

Within the combustion grate, the grate block 10 is positioned on a grate block which follows in the pushing direction S. To this end, the lowest region 32 of the front wall 20 is constructed in the form of a base 34 which is intended to be positioned on the support face of a grate block which is adjacent in the pushing direction S. The lowest region including the front support edge of the pushing face formed thereby is arranged in a plane E which extends substantially at right-angles with respect to the longitudinal axis L.

As shown in FIGS. 3 and 6, in the previously known grate block and in the specifically illustrated grate block according to the invention, in an upper region 36 of the front wall 20, that is to say, in a region facing the edge 19, two air supply openings 38 which extend through the wall for supplying air are formed on the combustion grate, wherein only one of these air supply openings is shown in the Figure.

In contrast to the grate block of the prior art, in the grate block 10 according to the invention in the region in which the upper edge 14 and the front wall 20 meet each other they are constructed in a thickened manner. Specifically, the wall thickening 40 is constructed in a curved manner when viewed as a longitudinal section.

The edge 19 formed by the wall thickening 40 is consequently when viewed along the longitudinal axis L and in the pushing direction S offset forward with respect to the plane E, wherein in the embodiment shown the spacing D between the edge 19 and the plane E is approximately 25 mm.

Furthermore, the air supply openings when viewed along the longitudinal axis L and in the pushing direction S are offset backward with respect to the edge, in the specifically shown embodiment by a spacing d of approximately 8 mm.

In the grate block according to the invention illustrated in FIG. 6, the air supply openings 38 extend when viewed as a longitudinal section at an angle α of approximately 90° with respect to the pushing face 22 in the region thereof directly adjacent to the respective air supply opening.

Figure 7:
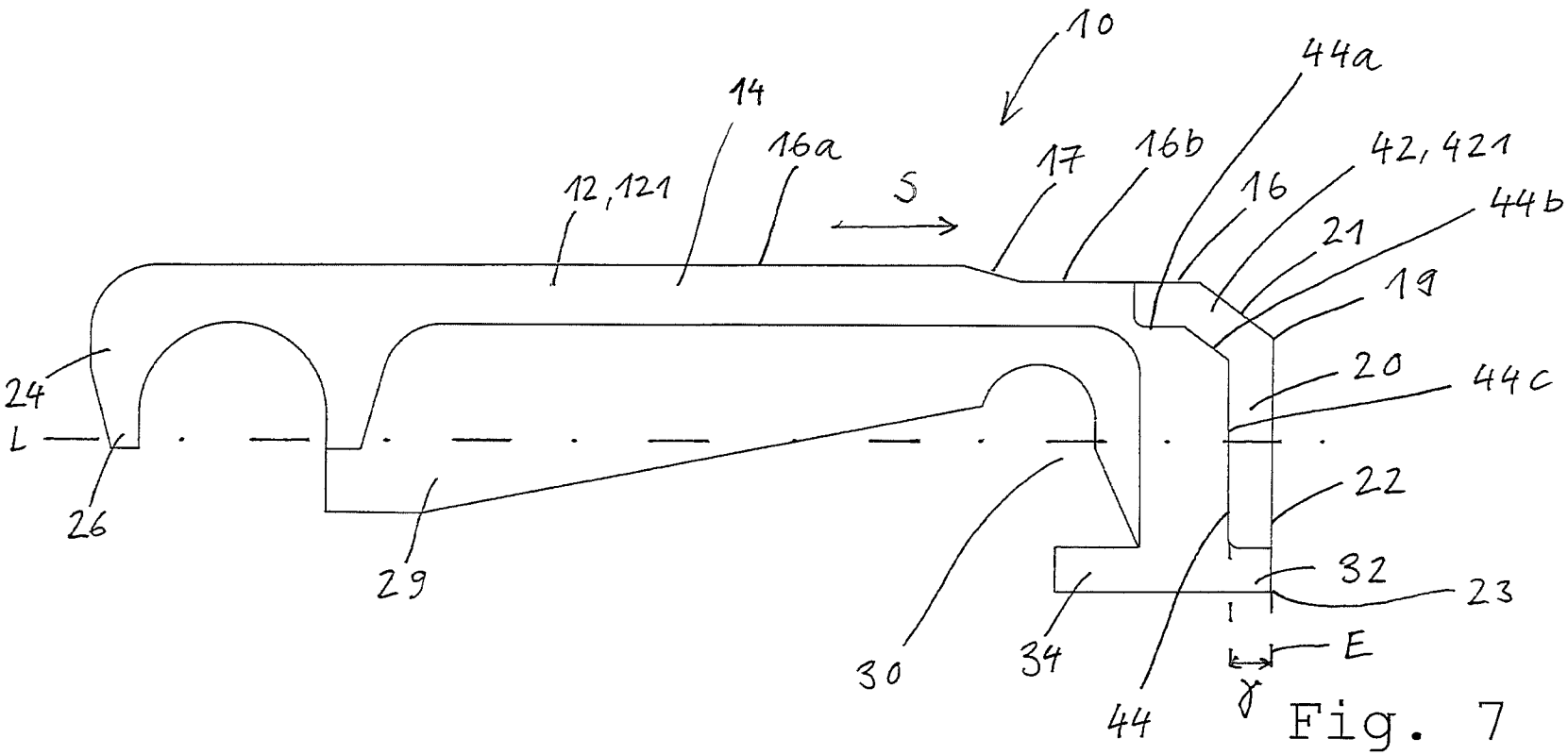
FIG. 7 is a side view of a grate block according to the second aspect of the present invention.
Figure 8:
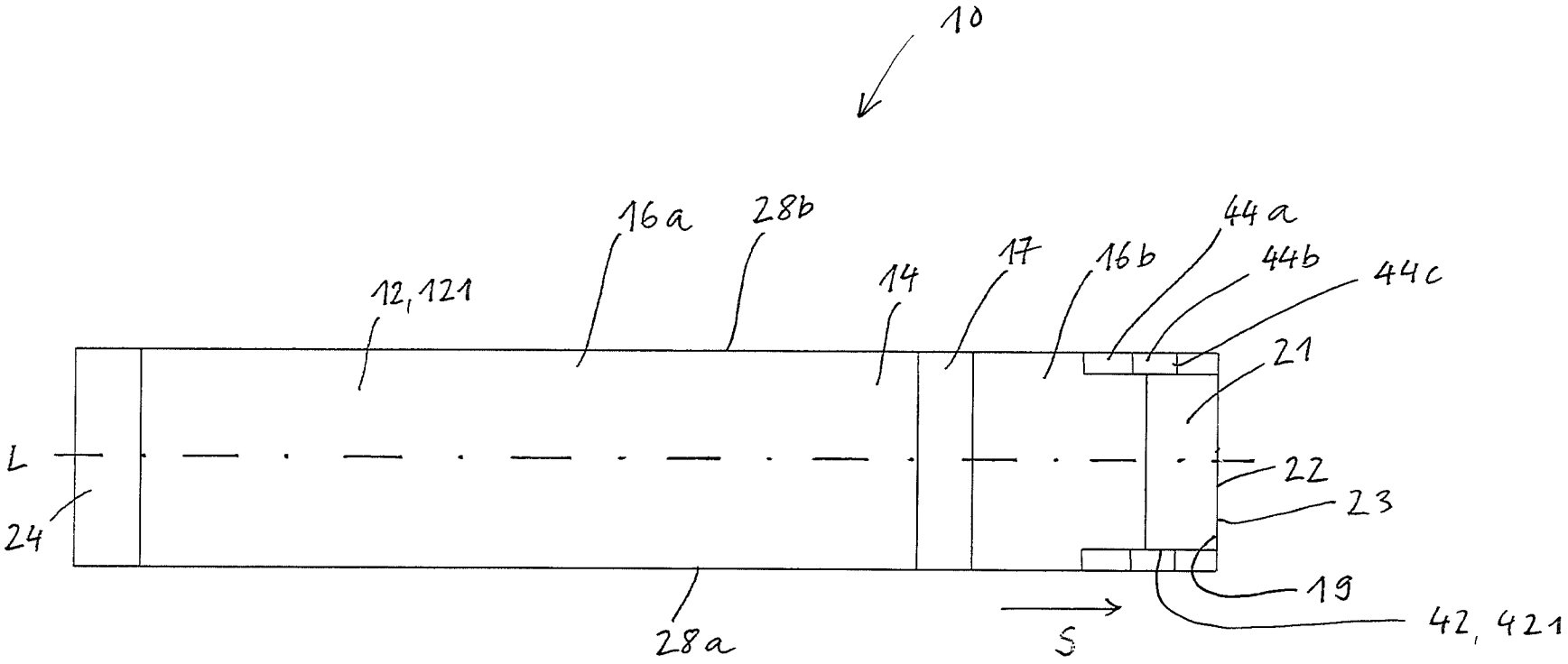
FIG. 8 is a plan view from above of the grate block according to FIG. 7.

According to the grate block of the second aspect of the present invention as shown in FIGS. 7 and 8, the side wall 28*a* has a wear marking 42 in the form of a recess 421 which describes a contour 44 which is spaced apart from the plane of the support face 16, in particular of the second support face region 16*b* and the chamfer 21, and from the plane of the pushing face 22. In this instance, the wear marking 42 or the contour 44 extends substantially parallel with the second support face region 16*b* and the chamfer 21 of the support face 16 and the pushing face 22. Consequently, the contour 44 extends in a first region 44*a* parallel with the plane of the second support face region 16*b*, in a second region 44*b* parallel with the chamfer 21 and in a third region 44*c* parallel with the pushing face 22.

In specific terms, the wear marking is in the embodiment shown spaced apart from the plane E of the pushing face 22 by a distance γ of approximately 20 mm.

During operation, the grate blocks 10 are moved relative to each other by means of the block retention pipes. Depending on whether the block retention pipes are associated with a stationary or a movable grate block, the block retention pipes are either secured to fixed consoles or to consoles which are arranged in a movable grate carriage. The driving is carried out by means of hydraulic cylinders which move the grate carriage back and forth via rollers on corresponding running surfaces.

As a result of the relative movement which is obtained thereby, the base 34 of a first grate block 10 is pushed forward and backward over the support face 16 of the subsequent grate block 10 in each case, wherein the combustion material is conveyed over the support face 16 before it is discharged over the edge 19 onto the support face 16 of the subsequent grate block 10.

As a result of the fact that the edge 19 is offset forward with respect to the plane E as described, it may be possible for at least a portion of the pushing face 22 to be subjected to reduced erosion by the combustion material and in particular for the air to be able to be discharged more readily through the air supply openings 38. Furthermore, as a result of the wall thickening 40 in the region of the grate block 10 which is subjected to particularly significant wear, a significantly greater abrasion can be tolerated, whereby an increased service-life of the grate block is ultimately achieved.

The degree of abrasion can be very easily determined by sight by means of the wear marking of the embodiment shown in FIGS. 7 and 8: if the abrasion has reached such an extent that the outer contour of the grate block 10 at least partially coincides with the contour of the wear marking 42 in the side view or the contour 44 of the wear marking 42 is no longer visible at all, the grate block 10 is worn and must be replaced.

As a result of the fact that the original spacing between the contour 44 of the wear marking 42 and the outer contour of the grate block 10 is known, it can additionally be predicted in a relatively reliable manner when the grate block will be worn with operation remaining consistent.

LIST OF REFERENCE NUMERALS

10 Grate block
12; 121 Block member; parallelepiped
14 Upper wall
16 Support face
16*a,b* Regions of the support face extending parallel with the longitudinal axis
17 Chamfered transition
19 Edge
20 Front wall
21 Chamfer
22 Pushing face
23 Front support edge
24 Rear wall of the block member
26 Hook
28*a, b* Side walls
29 Central web
30 Block member inner space
32 Lowest region of the front wall
34 Base
36 Upper region of the front wall
38 Air supply opening
40 Wall thickening
42; 421 Wear marking; recess
44; 44*a-c* Contour, different regions of the contour
L Longitudinal axis
S Pushing direction
d Spacing by which the air supply openings are offset backward with respect to the edge when viewed along the longitudinal axis L and in the pushing direction S
E Plane in which the front support edge is arranged
D Spacing by which the edge is offset forward with respect to the plane E along the longitudinal axis L and when viewed in the pushing direction S
α Angle at which the air supply opening extends with respect to the pushing face when viewed as a longitudinal section
γ Distance by which the wear marking is spaced from the plane of the pushing face

The invention claimed is:

1. A grate block for a combustion grate in which a plurality of sequential grate blocks are arranged one above the other in a step-like manner, the plurality of sequential grate blocks being configured so as to rearrange and convey combustion material during combustion by pushing movements that are carried out relative to each other, the grate block comprising:

a block member integrally formed as a cast component, the block member including:

an upper wall forming a support face that extends at least partially parallel with a longitudinal axis of the block member, the combustion material being conveyed along the support face of the upper wall, and a foremost end of the upper wall, when viewed in a pushing direction, forms an edge via which the support face descends into a pushing face;

a front wall forming the pushing face, the front wall including at least one air supply opening which, when viewed as a longitudinal section, extends perpendicularly or obliquely with respect to the pushing face to supply air to the combustion grate, the front wall forming a base in a lowest region of the front wall, which is configured to be positioned on a corresponding support face of an adjacent grate block, which is adjacent in the pushing direction; and at least one side wall including at least one wear marking formed on the side wall of the grate block, wherein:

at least a front support edge of the pushing face is arranged in a plane extending substantially perpendicularly to the longitudinal axis, the edge of the foremost end of the upper wall is offset forward with respect to the plane when viewed along the longitudinal axis and in the pushing direction, the at least one air supply opening is arranged below the edge of the foremost end of the upper wall and is offset backward with respect to the edge of the foremost end of the upper wall when viewed along the longitudinal axis and in the pushing direction, and the upper wall and the front wall each include a wall thickening region, which is thicker than a remaining portion of each of the upper wall and the front wall, each wall thickening region being formed where the upper wall and the front wall intersect each other, and each wall thickening region is curved when viewed in a longitudinal cross-section.

2. The grate block as claimed in claim 1, wherein the edge of the foremost end of the upper wall when viewed along the longitudinal axis and in the pushing direction is offset forward with respect to the plane by at least 3 mm.

3. The grate block as claimed in claim 1, wherein the edge of the foremost end of the upper wall when viewed along the longitudinal axis and in the pushing direction is offset forward with respect to the plane by a maximum of 100 mm.

4. The grate block as claimed in claim 1, wherein the at least one air supply opening, when viewed as a longitudinal cross-section, extends at an angle with respect to the region of the pushing face directly adjacent to the at least one air supply opening, the angle being from 90° to 135°.

5. The grate block as claimed in claim 1, wherein the side wall closes the grate block on at least one side, the side wall extending in the longitudinal direction, and the wear marking defining a contour that is spaced apart from the plane of the support face or from the plane of the pushing face.

6. The grate block as claimed in claim 5, wherein the contour of the wear marking is spaced apart from the plane of the support face or from the plane of the pushing face by from 15 mm to 30 mm.

7. The grate block as claimed in claim 5, wherein the contour of the wear marking extends at least partially parallel with the plane of the support face or the plane of the pushing face.

8. The grate block as claimed in claim 7, wherein the contour of the wear marking extends parallel at least with the region of the support face and the pushing face where the upper wall and the front wall intersect each other.

9. The grate block as claimed in claim 5, wherein the wear marking is a continuous or interrupted notch or a recess.

10. A combustion grate comprising at least one of the plurality of grate blocks as claimed in claim 1.

11. A method comprising burning waste from the combustion grate as claimed in claim 10.

12. A waste combustion installation comprising the combustion grate as claimed in claim 10.

13. A grate block for a combustion grate in which a plurality of sequential grate blocks are arranged in a step-like manner one above the other, the plurality of sequential grate blocks being configured so as to rearrange and convey combustion material during a combustion operation by pushing movements that are carried out relative to each other, the grate block comprising:

a block member constructed as a cast component, the block member including:

an upper wall forming a support face that extends at least partially parallel to a longitudinal axis of the block member, the combustion material being conveyed along the support face of the upper wall, a foremost end of the upper wall, when viewed in a pushing direction, forms an edge via which the support face descends into a pushing face;

a front wall forming the pushing face; and at least one side wall closing the grate block on at least one lateral side, the at least one side wall extending in the longitudinal direction, the at least one side wall having a wear marking formed on the at least one side wall and defining a contour that is spaced apart from edges of the plane of the support face or from edges of the plane of the pushing face.

* * * * *